US011414947B2

(12) United States Patent
Evans

(10) Patent No.: US 11,414,947 B2
(45) Date of Patent: Aug. 16, 2022

(54) RELEASE MECHANISM FOR A JARRING TOOL

(71) Applicant: Robert W. Evans, Conroe, TX (US)

(72) Inventor: Robert W. Evans, Conroe, TX (US)

( * ) Notice: Subject to any disclaimer, the term of this patent is extended or adjusted under 35 U.S.C. 154(b) by 534 days.

(21) Appl. No.: 16/250,836

(22) Filed: Jan. 17, 2019

(65) Prior Publication Data

US 2020/0232296 A1 Jul. 23, 2020

(51) Int. Cl.
*E21B 31/107* (2006.01)

(52) U.S. Cl.
CPC ..... *E21B 31/107* (2013.01)

(58) Field of Classification Search
CPC ..... E21B 31/107; E21B 17/06; E21B 23/00
See application file for complete search history.

(56) References Cited

U.S. PATENT DOCUMENTS 2,008,743 A * 7/1935 Millard ..... E21B 31/107 175/304
2,047,209 A 7/1936 Lawlor
2,065,135 A 12/1936 Sumter et al.
2,618,466 A 11/1952 Bagnell et al.
2,618,467 A 11/1952 Bagnell et al.
2,903,241 A 9/1959 Brown
3,371,730 A 3/1968 Newman
3,414,061 A 12/1968 Nutter
3,606,926 A * 9/1971 Schwegman ..... E21B 34/14 166/383
3,658,140 A 4/1972 Berryman
3,685,599 A 8/1972 Kisling
3,709,478 A 1/1973 Kisling, III
3,797,591 A * 3/1974 Berryman ..... E21B 31/113 175/296
4,036,312 A 7/1977 DeLuish
4,376,468 A 3/1983 Clark
5,022,473 A 6/1991 Taylor
5,069,282 A 12/1991 Taylor
5,133,404 A 7/1992 Dillison
5,624,001 A 4/1997 Evans
6,290,004 B1 8/2001 Evans
(Continued)

FOREIGN PATENT DOCUMENTS

WO 2016130308 8/2016

OTHER PUBLICATIONS

USPTO Office Action for U.S. Appl. No. 16/168,610 dated May 24, 2019.

(Continued)

*Primary Examiner* — Shane Bomar
(74) *Attorney, Agent, or Firm* — Tumey L.L.P.

(57) ABSTRACT

A release mechanism for a jarring tool is formed by a plurality of segmented release lugs. Each lug includes a plurality of axial spaced projections on an inner surface and a plurality of grooves on an outer surface. The projections may have either different widths or may be separated by varying distances and releasably engage corresponding grooves in a mandrel located within a housing of the tool. The release lugs are positioned between a trigger sleeve and the mandrel. In one embodiment, the release lugs are positioned within a support collar. In a second embodiment, the lugs are provided with stabilizing posts and cavities that serve to maintain the lugs in a proper alignment.

4 Claims, 5 Drawing Sheets

(56) References Cited

U.S. PATENT DOCUMENTS

| | | | | |
|---|---|---|---|---|
| 6,948,560 | B2 | 9/2005 | Marsh | |
| 7,510,008 | B2 | 3/2009 | Evans | |
| 8,205,690 | B2 | 6/2012 | Evans | |
| 8,720,540 | B2 | 5/2014 | Gano | |
| 2005/0087338 | A1* | 4/2005 | Parker | E21B 34/14 166/242.6 |
| 2005/0183889 | A1 | 8/2005 | Marsh | |
| 2015/0144358 | A1 | 5/2015 | Mejia et al. | |
| 2015/0226031 | A1 | 8/2015 | Hekelaar | |
| 2016/0024886 | A1 | 1/2016 | Williamson | |
| 2016/0237771 | A1 | 8/2016 | Evans | |
| 2018/0252064 | A1 | 9/2018 | Evans | |
| 2019/0055804 | A1 | 2/2019 | Evans | |

OTHER PUBLICATIONS

USPTO Final Office Action for U.S. Appl. No. 16/824,179 dated Mar. 30, 2021.
European Examination Report for Application No. 19172632.2-1002 dated Jan. 29, 2021.
Extended European Search Report and Written Opinion for Application No. 19172632.2 dated Oct. 30, 2019.
USPTO Issue Notification for U.S. Appl. No. 16/168,610 dated May 13, 2020.
USPTO Issue Notification for U.S. Appl. No. 15/973,247 dated Aug. 21, 2019.
International Search Report and Written Opinion for Application No. PCT/US16/15161 dated Jul. 11, 2016.
Non-Final Office Action for U.S. Appl. No. 14/621,577 dated Feb. 22, 2018.
Non-Final Office Action for U.S. Appl. No. 14/621,577 dated May 10, 2017.
Final Office Action for U.S. Appl. No. 14/621,577 dated Jul. 6, 2018.
Final Office Action for U.S. Appl. No. 14/621,577 dated Aug. 28, 2017.
Notice of Allowance for U.S. Appl. No. 14/621,577 dated Oct. 1, 2018.
Notice of Allowance for U.S. Appl. No. 15/973,247 dated Apr. 29, 2019.
International Preliminary Report for International Patent Application No. PCT/US2016/015161 dated Aug. 15, 2017.
USPTO Final Office Action for U.S. Appl. No. 15/973,247 dated Dec. 12, 2018.
USPTO Non-final Office Action for U.S. Appl. No. 15/973,247 dated Jul. 11, 2018.
European Patent Office Search Report and Written Opinion for Application No. 16749589.4 dated Feb. 13, 2019.
Extended European Search Report for Application No. 19200264.0 dated Mar. 25, 2020.
European Search Report for Application No. EP19172632 dated Oct. 23, 2019.
European Examination Report for Application No. 16749589.4 dated Oct. 28, 2019.
USPTO Notice Of Allowance for U.S. Appl. No. 16/168,610 dated Dec. 11, 2019.

* cited by examiner

RELEASE MECHANISM FOR A JARRING TOOL

FIELD OF THE INVENTION

This invention is directed to a release mechanism for a mandrel of a jarring device commonly referred to as a jar and is related to application Ser. No. 16/168,610 filed Oct. 23, 2018, the entire contents of which is incorporated herein by reference thereto. Jars are used in the well drilling industry to free downhole tools that may become lodged in a well. An upward or downward force can be supplied to a tubular string which includes the affected tool in order to break free the tool from the well bore.

BACKGROUND OF INVENTION

Description of Related Art

Typically, a release mechanism in the form of an annular collet is provided which normally prevents axial movement of the mandrel. The mandrel is spring biased to move with significant force in an upward or downward direction. If a sufficient force is placed on the mandrel, the collet will release.

U.S. Pat. No. 5,022,473 discloses a release assembly which comprises a plurality of angular segments 62 and 162 that engage in slots 86 and 88, and 186 and 188 respectively. It has been found that this arrangement can result in the segments 62 and 162 becoming out of alignment which could result in the failure of the release mechanism. As disclosed in the patent, the jar requires two sets of release lugs to withstand the anticipated tensile load. In this design the two lug assemblies must be spaced further apart than the total travel of the jar to prevent the lower lug from inadvertently engaging the groove of the upper lug assembly. If a third lug assembly were necessary it would have to be spaced a distance greater than the jar stroke from the lower set. This would significantly increase the total length of the jar and also the cost.

BRIEF SUMMARY OF THE INVENTION

The present invention solves the above noted problem by providing a plurality of angular lug segments each of which has two or more projections that engage corresponding grooves in the mandrel. The segments may be positioned within cutouts of an annular support collar or may include projections that are adapted to be received in recess of adjoining lug segments to stabilize the segments.

In order to avoid misalignment or a jarring situation, the projections having either a differing width or are spaced at different distances. The grooves on the mandrel have a complimentary configuration as will be explained below.

BRIEF DESCRIPTION OF THE SEVERAL VIEWS OF THE DRAWING(S)

DETAILED DESCRIPTION OF THE INVENTION

Figure 1:
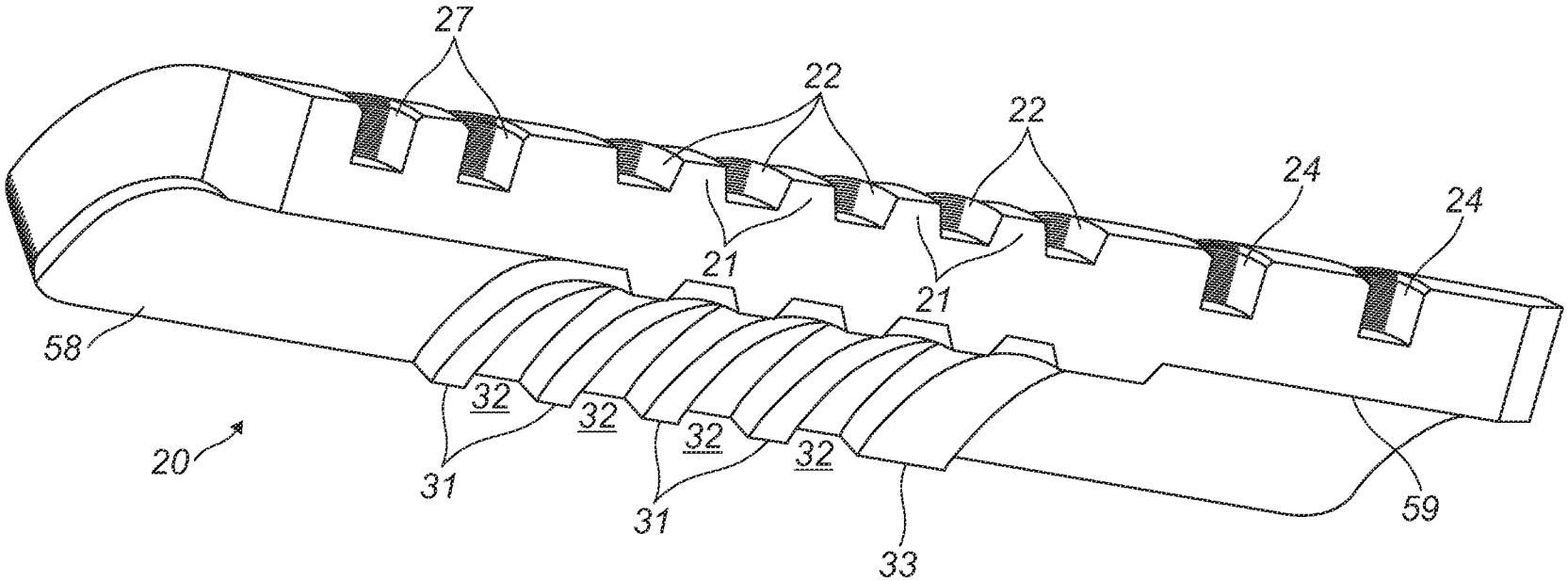
FIG. 1 is a perspective view of a first embodiment of a release lug.
Figure 3:
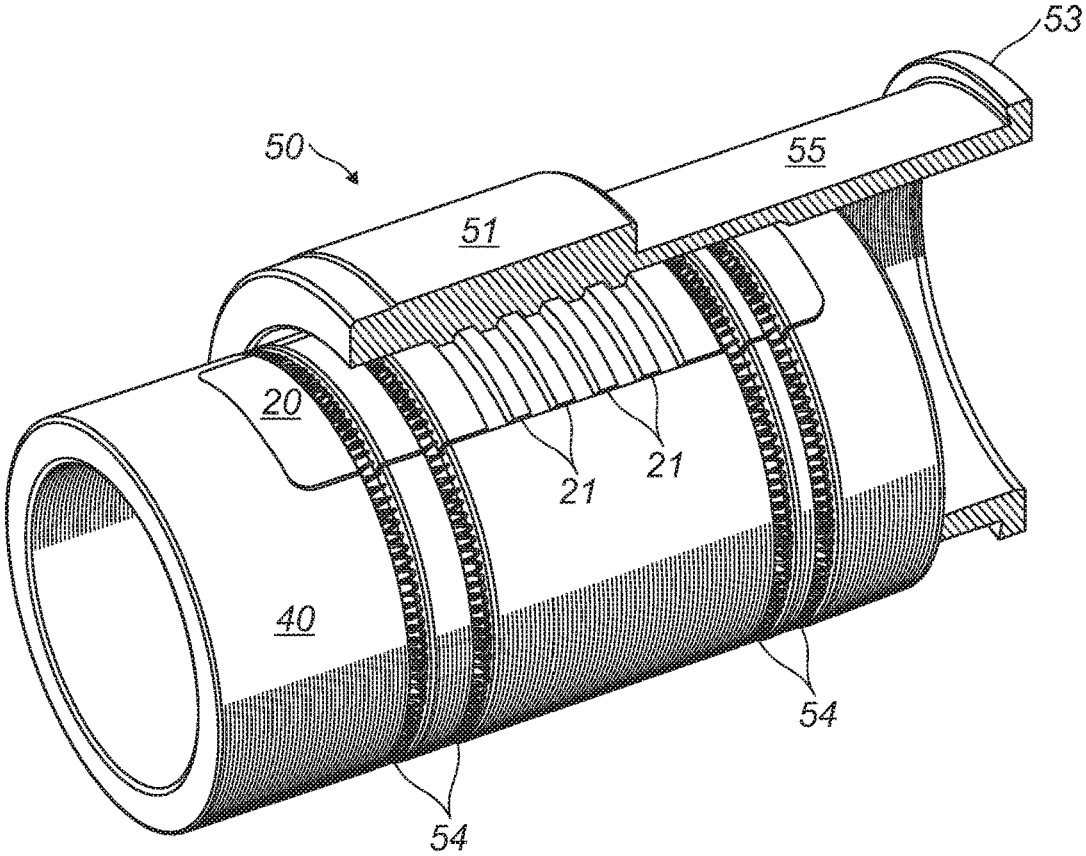
FIG. 3 is a cross-sectional and perspective view of the release mechanism.

FIG. 1 illustrates a single release lug 20. It includes a plurality of grooves 27 and 24 in its outer surface that are adapted to receive a plurality of springs 54 as shown in FIG. 3. The springs may be garter springs as shown or annular leaf springs.

Each lug 20 also includes a plurality of grooves 22 on their outer surface which form a plurality of ridges 21. The inner surface of each leg includes a plurality of grooves 32 which in turn form a plurality of ridges 31 and 33. The inner surface also includes two accurate surfaces 58 and 59.

Figure 2:
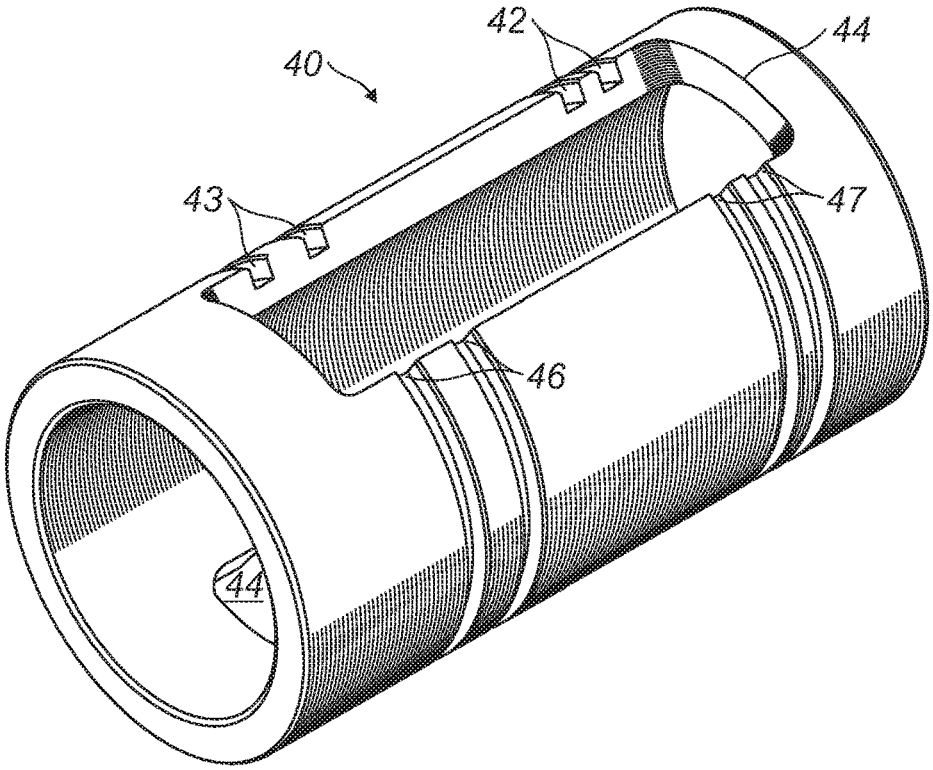
FIG. 2 is a perspective view of an annular support collar.

As shown in FIG. 2 an annular support collar 40 includes one or more cutout sections 44 that are adapted to receive lugs 20. Support collar 40 also includes a plurality of grooves 42, 43, 46, and 47 that are adapted to receive stabilizing springs 54.

FIG. 3 shows the lugs 20 positioned within cutouts 44 with springs 54 positioned within the grooves provided on the outer surface of lugs 20 and support collar 40. Also shown in FIG. 3 is a trigger sleeve 50 which includes an annular lip 53, a first surface 55 and a thick portion 51 on the outer surface.

Figure 4:
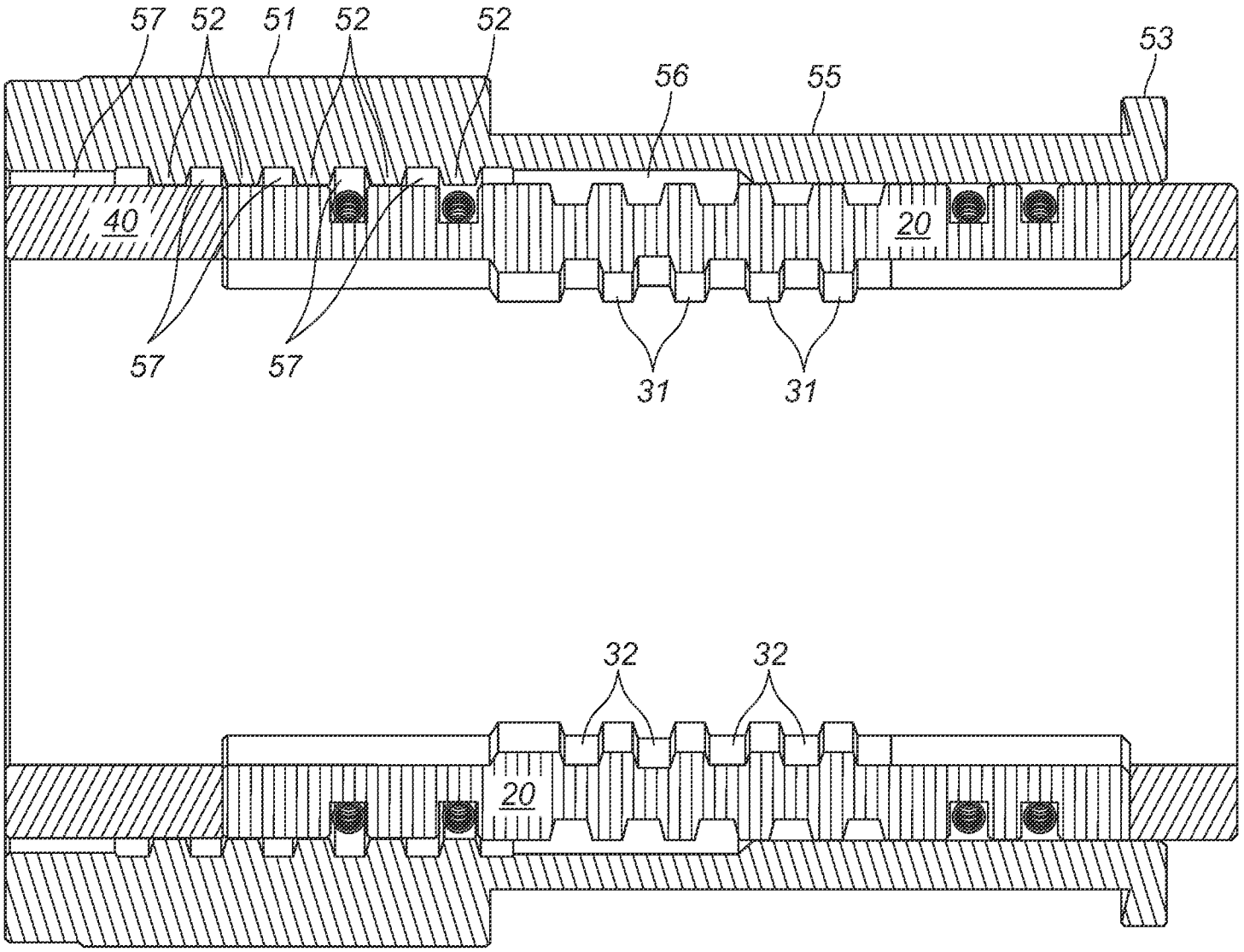
FIG. 4 is a cross-sectional view of the release in mechanism in a non-release position.

FIG. 4 illustrates the release mechanism in an assembled position. The mandrel of the jarring device, not shown, would be located within the release mechanism as is known in the art. The outer surface of the mandrel would include a plurality of ridges and grooves as shown at 31 and 32 in the above mentioned patent application.

The interior surface of trigger sleeve 50 includes a plurality of grooves 56 and 57 forming a plurality of ridges 52. In the position of FIG. 4 the mandrel would be in the non-release position. As support collar 40 and lugs 20 are axially moved to the left as shown in FIG. 4, ridge 21 on the outer surface of lug 20 will be free to engage into grooves 57 of the release trigger 50. Release lugs 20 will move radially outward which will disengage the release lugs 20 from the mandrel. This in turn will allow the mandrel to cause the jarring force as is known in the art.

Figure 5:
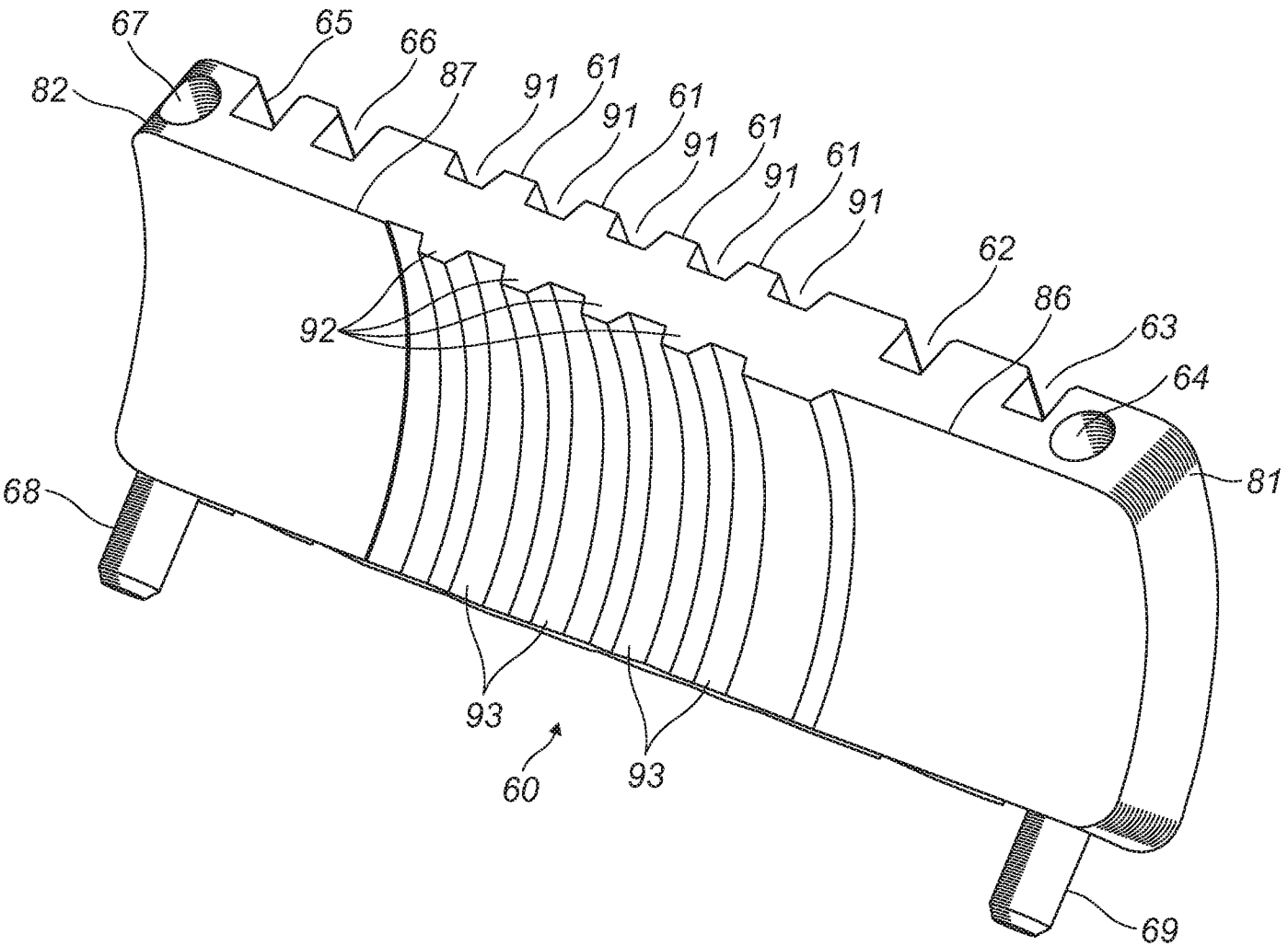
FIG. 5 is a perspective view of a release lug according to a second embodiment of the invention.
Figure 6:
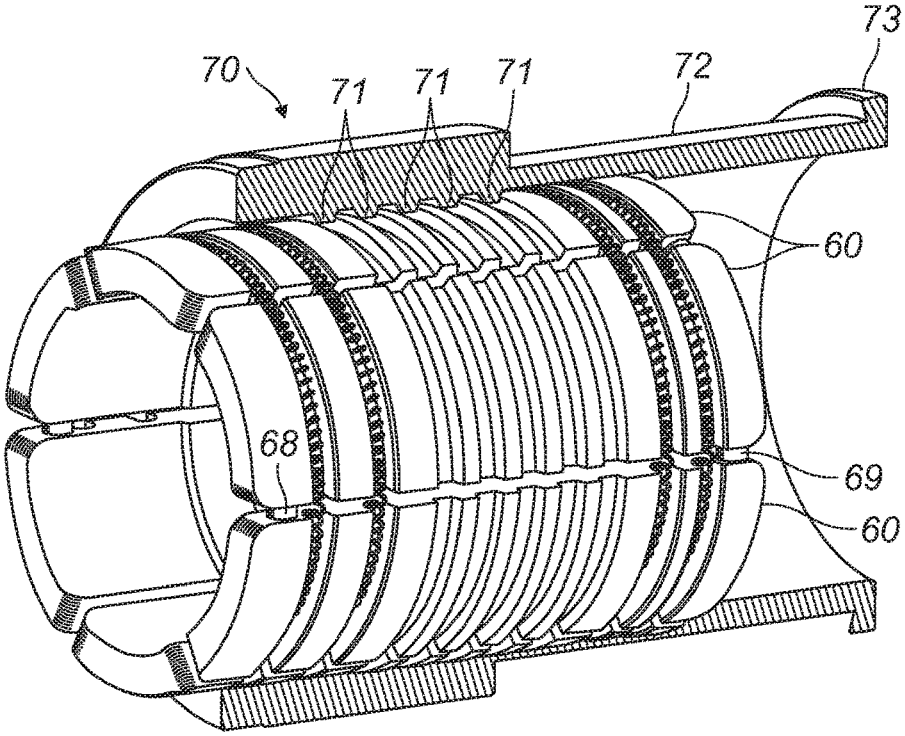
FIG. 6 is a perspective view of a release mechanism according to a second embodiment of the invention.
Figure 7:
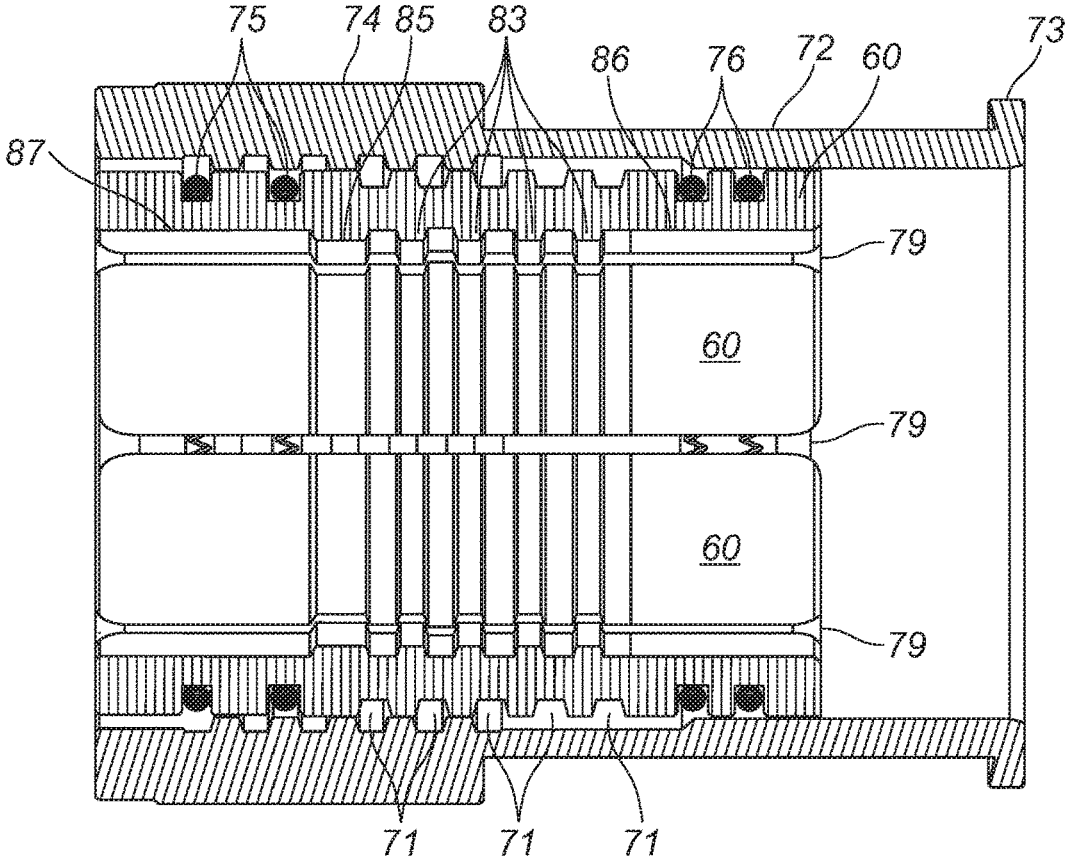
FIG. 7 is a cross-sectional view of the second embodiment of the release mechanism shown in a non-release position.

FIGS. 5-7 illustrates a second embodiment of the invention. In this embodiment, each lug 60 is similar to the lug shown in FIG. 1 but each lug includes a pair of posts 68, 69, one at each end, and a pair of cavities 64, 67 one at each end of the lug. Cavities 64, 67 are adapted to receive the posts 68, 69 of an adjacent lug as shown in FIG. 6. Each lug includes a plurality of ridges 61 and grooves 91 on its exterior surface and a plurality of ridges 92 and grooves 93 on its interior surface.

Grooves 62, 63, 65, and 66 are located on the exterior surface of each lug for receiving annular springs 75, 76 which may be a garter or leaf spring.

As shown in FIG. 6, the release mechanism 70 includes a plurality of lugs 60 that are positioned to form an annular array. Each lug is initially spaced apart from an adjacent lug by a distance 79. Posts 68, 69 are located within cavities 64, 67 of an adjacent lug. As a result, the assembly of lugs can expand and contract in a radial direction depending upon the longitudinal relationship between the lugs and the trigger sleeve 70.

Trigger sleeve 70 includes a plurality of ridges 71 that form grooves which allow lugs 60 to expand radially outward when ridges 71 of the trigger sleeve align with grooves 91 of the lugs.

Trigger sleeve 70 includes an annular lip 73, an annular section 72 and a raised annular section 74.

In order to operate the jarring device a load is put on the mandrel, not shown, to the left as shown in FIG. 7. The mandrel which includes ridges and grooves will carry the release lugs to the left while the trigger sleeve remains stationary. As grooves 91 in the lugs align with ridges 71 in the trigger sleeve, the release assembly will expand radially outwardly allowing the mandrel to be released. During the expansion the dimension of posts 68, 69 and cavities 67, 64 are selected so that the posts 68 and 69 are located within the cavities during the entire release and reset positions.

Although the present invention had been described with respect to specific details, it is not intended that such details should be regarded as limitations on the scope of the invention, except to the extent that they are included in the accompanying claims.

What is claimed is:

1. A release mechanism for a jarring tool having a mandrel comprising:

a) a plurality of release lugs, each lug including a plurality of ridges and grooves on an exterior surface thereof and a plurality of ridges and grooves on an internal surface thereof, b) an annular support collar having a plurality of cutout portions and adapted to surround a mandrel of a jarring tool, c) an annular trigger sleeve surrounding the annular support collar, the release lugs positioned within the cutout portions of the annular support collar and adapted to move radially outward to thereby releasing the mandrel of the jarring tool;

wherein the annular support collar includes grooves on an exterior surface of the annular support collar and a plurality of annular springs positioned within the grooves and overlying the release lugs.

2. The release mechanism of claim 1 wherein the trigger sleeve includes a plurality of grooves and ridges located on an interior surface of the trigger sleeve.

3. The release mechanism of claim 2 wherein the grooves and ridge are positioned on a thickened portion of the trigger sleeve.

4. The release mechanism of claim 1 wherein the release lugs include spring retaining grooves on an exterior surface thereof.

* * * * *